US010505313B2

(12) United States Patent
Kawashima

(10) Patent No.: US 10,505,313 B2
(45) Date of Patent: Dec. 10, 2019

(54) CONNECTOR

(71) Applicant: Sumitomo Wiring Systems, Ltd., Yokkaichi, Mie (JP)

(72) Inventor: Naomichi Kawashima, Mie (JP)

(73) Assignee: Sumitomo Wiring Systems, Ltd. (JP)

( * ) Notice: Subject to any disclaimer, the term of this patent is extended or adjusted under 35 U.S.C. 154(b) by 0 days.

(21) Appl. No.: 16/149,364

(22) Filed: Oct. 2, 2018

(65) Prior Publication Data

US 2019/0103704 A1 Apr. 4, 2019

(30) Foreign Application Priority Data

Oct. 4, 2017 (JP) ..... 2017-194152

(51) Int. Cl.
*H01R 13/62* (2006.01)
*H01R 13/627* (2006.01)
*H01R 13/502* (2006.01)

(52) U.S. Cl.
CPC ..... *H01R 13/6272* (2013.01); *H01R 13/502* (2013.01)

(58) Field of Classification Search
CPC ..... H01R 13/6271; H01R 13/6272; H01R 13/6273
See application file for complete search history.

(56) References Cited

U.S. PATENT DOCUMENTS 5,368,500 A * 11/1994 Dedering ..... H01R 13/5213 206/523
7,731,519 B1 * 6/2010 Swenson, Jr. ..... H01R 13/6271 439/352

FOREIGN PATENT DOCUMENTS

JP 2002-203638 7/2002

* cited by examiner

*Primary Examiner* — Ross N Gushi
(74) *Attorney, Agent, or Firm* — Gerald E. Hespos; Michael J. Porco; Matthew T. Hespos

(57) ABSTRACT

A connector includes a first housing 10 having a resiliently deformable lock arm (25), and a lock hole (28) is formed in the lock arm (25). A second housing (50) is connectable to and separable from the first housing (10). A lock projection (53) is formed on the second housing (50) and is configured to lock the housings (10, 50) in a connected state by being locked to the lock hole (28). A wire cover (33) is attached to the first housing (10) and is configured to turn wires (32) drawn out from the first housing (10). A covering portion (39) is formed on the wire cover (33) and covers a locking part of the lock hole (28) and the lock projection (53) from an outer surface side.

4 Claims, 7 Drawing Sheets

CONNECTOR

BACKGROUND

Field of the Invention

The invention relates to a connector.

Related Art

Japanese Unexamined Patent Publication No. 2002-203638 discloses a connector with a female housing formed with a resiliently deformable lock arm and a male housing formed with a lock protrusion. The lock arm is formed with a lock hole. When the housings are connected, the lock protrusion is locked to the lock hole so that the housings are locked in a connected state.

A locking part of the lock hole and the lock protrusion is exposed on an outer surface of the above-described connector. Thus, mud spattered from a road surface during travel may adhere to the locking part of the lock hole and the lock protrusion. If this adhering mud is dried and hardened, it may become impossible to unlock the lock arm.

The invention was completed on the basis of the above situation and aims to prevent an unlocking operation of a lock arm from being hindered.

SUMMARY

The invention is directed to a connector with first and second housings. The first housing includes a resiliently deformable lock arm, and a lock hole is formed in the lock arm. The second housing is connectable to and separable from the first housing. A lock projection is formed on the second housing and is configured to lock the first housing and the second housing in a connected state by being locked to the lock hole. A wire cover is to be attached to the first housing and is configured to turn a wire drawn out from the first housing. A covering portion is formed on the wire cover and is configured to cover a locking part of the lock hole and the lock projection from an outer surface.

The covering portion covers the locking part of the lock hole and the lock projection. Thus, there is no possibility of hindering an unlocking operation of the lock arm due to the adhesion of external matter to the locking part of the lock hole and the lock projection.

In one embodiment, an operating portion is formed on the lock arm and can be pressed to disengage the lock hole from the lock projection. An opening may be formed in the wire cover and may be configured to expose the operating portion. Accordingly, the lock arm can be unlocked without detaching the wire cover from the first housing.

The opening may be open to the outside of the wire cover on an outer edge part of the wire cover, and the covering portion couples two areas adjacent to an opening end of the opening. If the opening was open on the outer edge of the wire cover, the strength of the outer edge of the wire cover may be reduced. However, the areas adjacent to the opening end of the opening are coupled by the covering portion. Thus, the outer edge part of the wire cover is strong.

An intrusion restricting portion may be formed on the wire cover and may be accommodated in an area not interfering with the lock projection out of the lock hole. If an opening area of the lock hole is increased, the formation of sinks of the lock arm can be suppressed in a molding step, but the intrusion of an external matter into the lock hole becomes easier. However, the intrusion restricting portion is accommodated in the lock hole, even if the opening area of the lock hole is increased. Thus, the intrusion of an external matter into the lock hole can be restricted.

The intrusion restricting portion may extend from the covering portion. Thus, no clearance is present between the covering portion and the intrusion restricting portion, and a function of restricting the intrusion of external matter into the lock hole is excellent.

DETAILED DESCRIPTION

Figure 1:
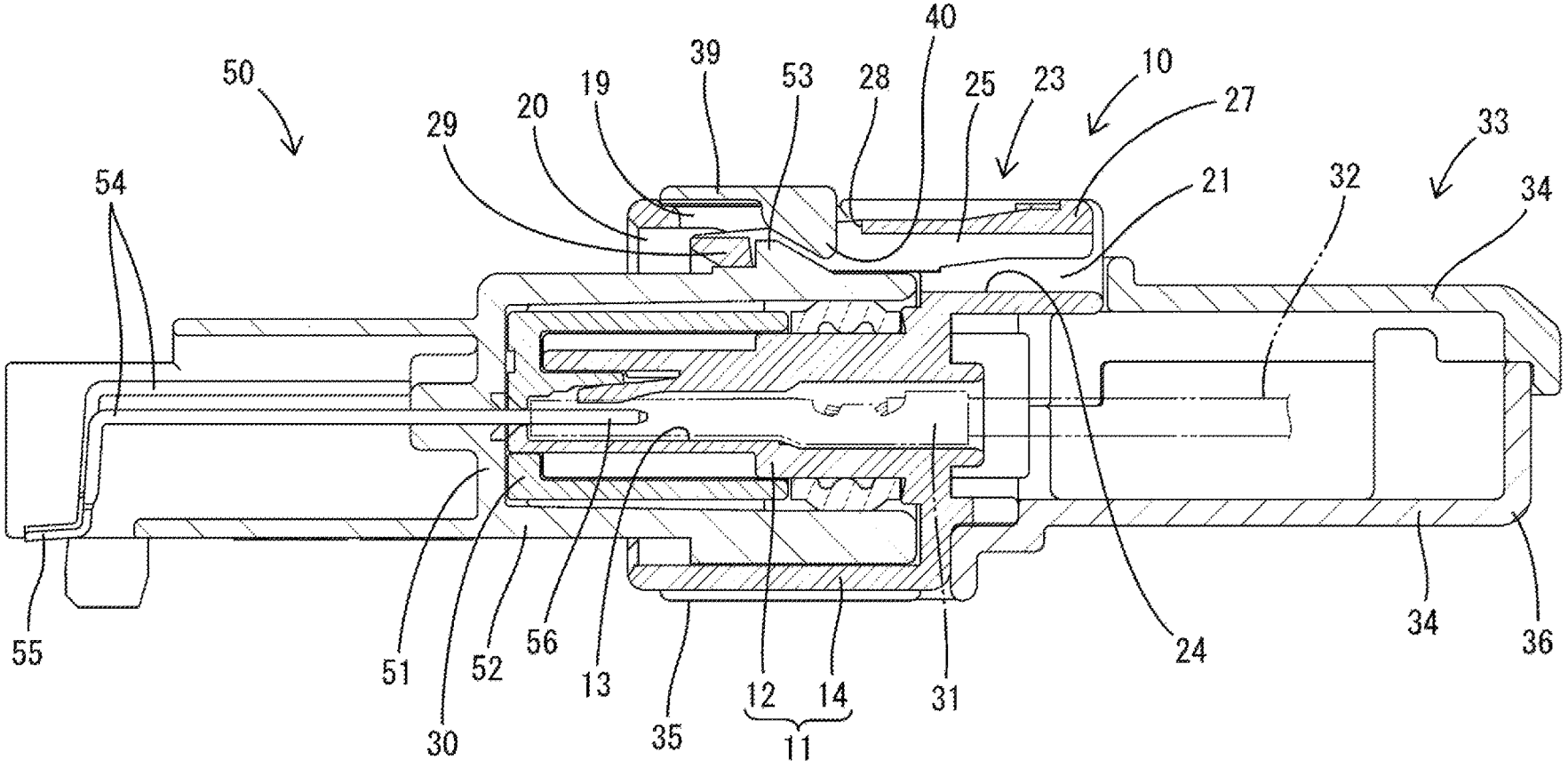
FIG. 1 is a section showing a state where a first housing and a second housing are connected in one embodiment.
Figure 2:
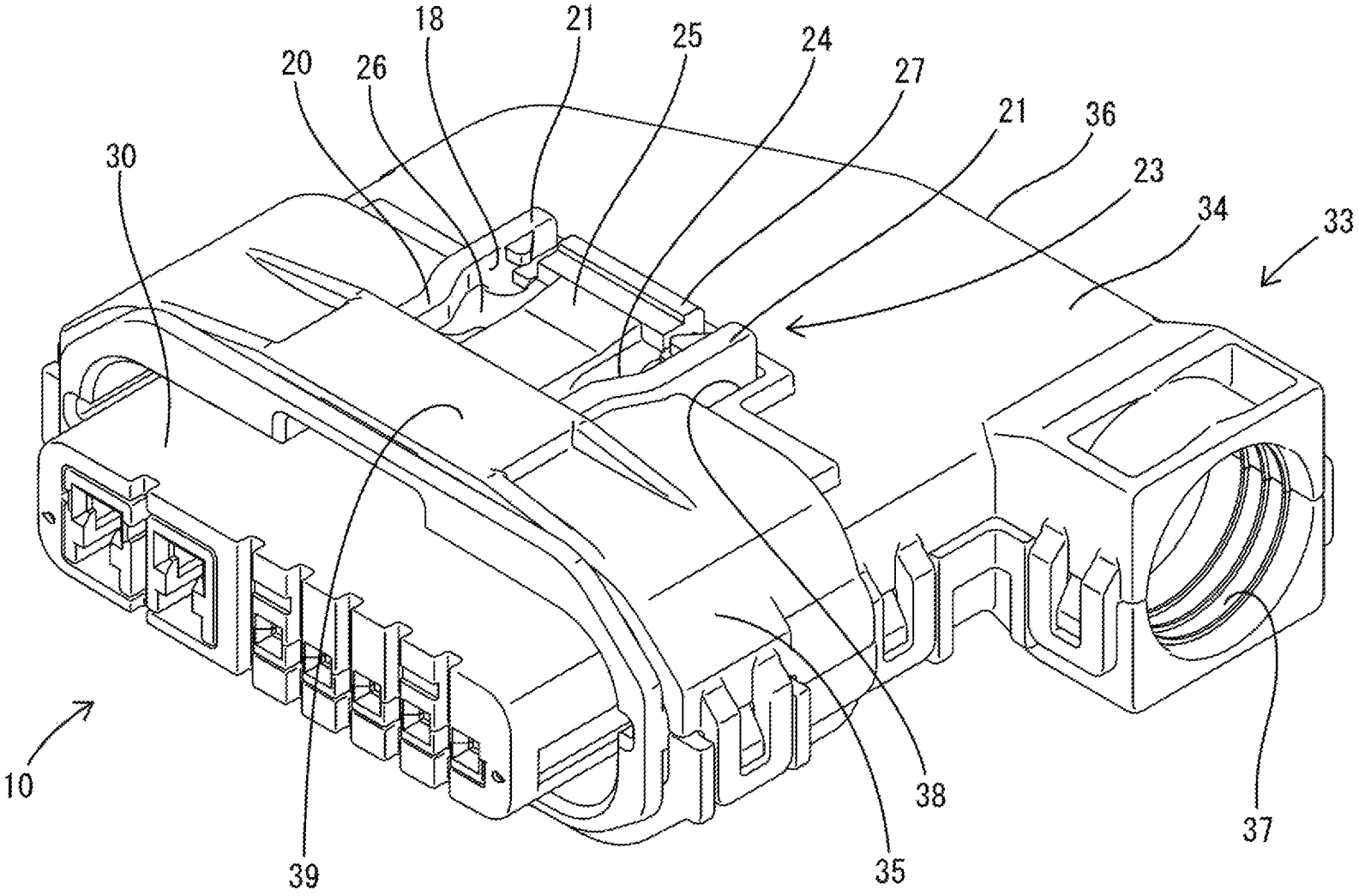
FIG. 2 is a perspective view showing a wire cover attached to the first housing.
Figure 3:
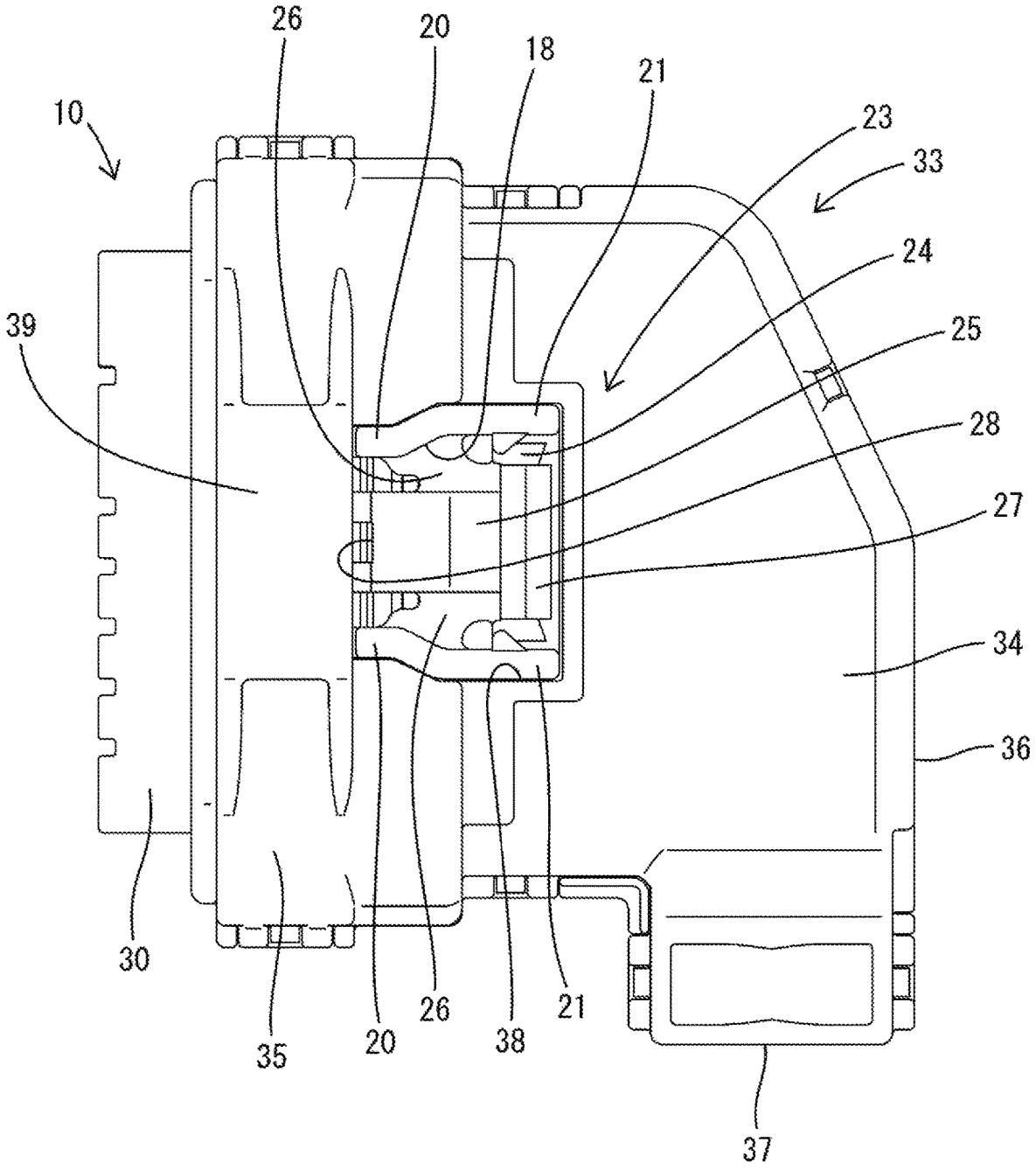
FIG. 3 is a plan view showing the wire cover is attached to the first housing.
Figure 4:
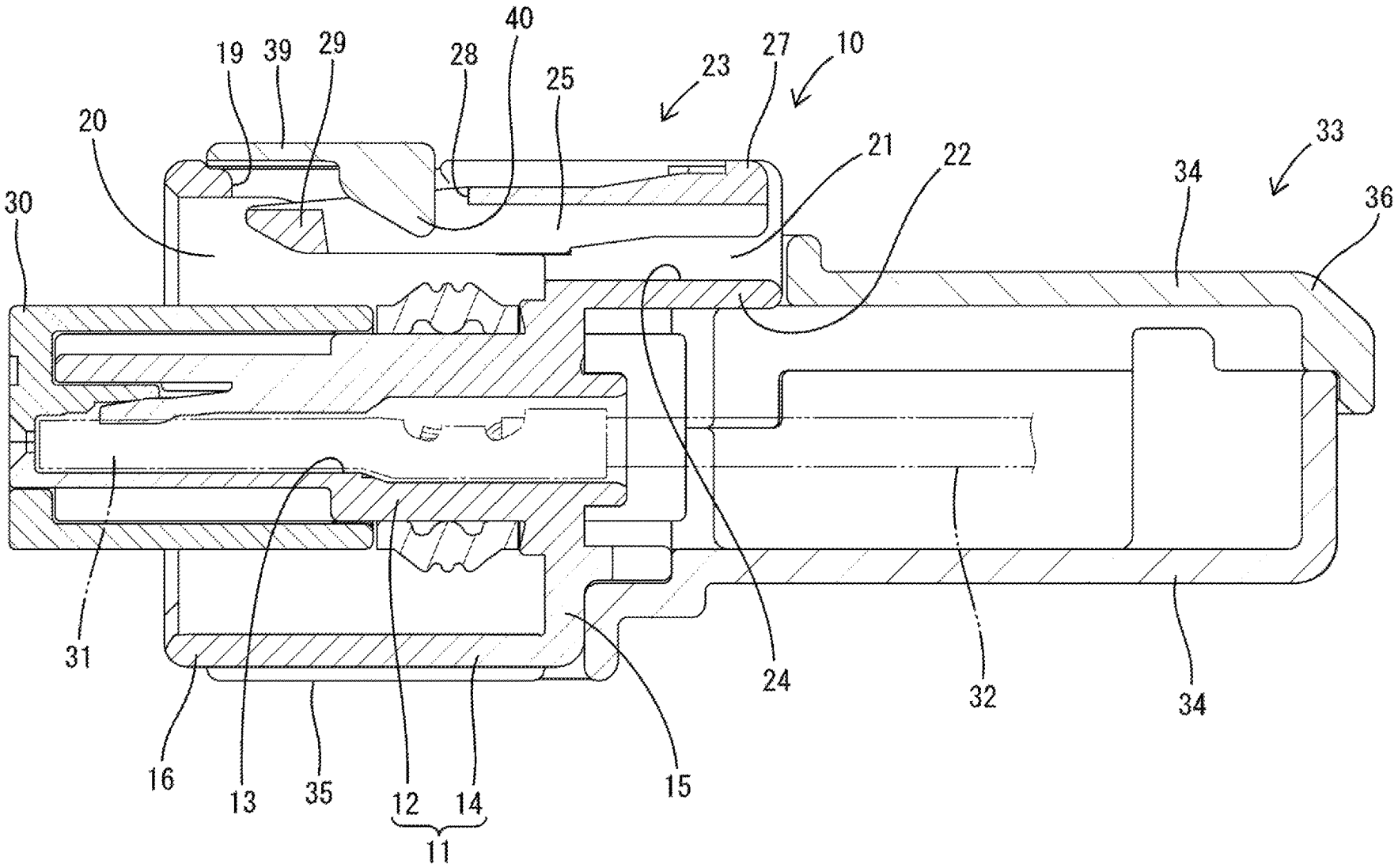
FIG. 4 is a section showing the wire cover attached to the first housing.
Figure 5:
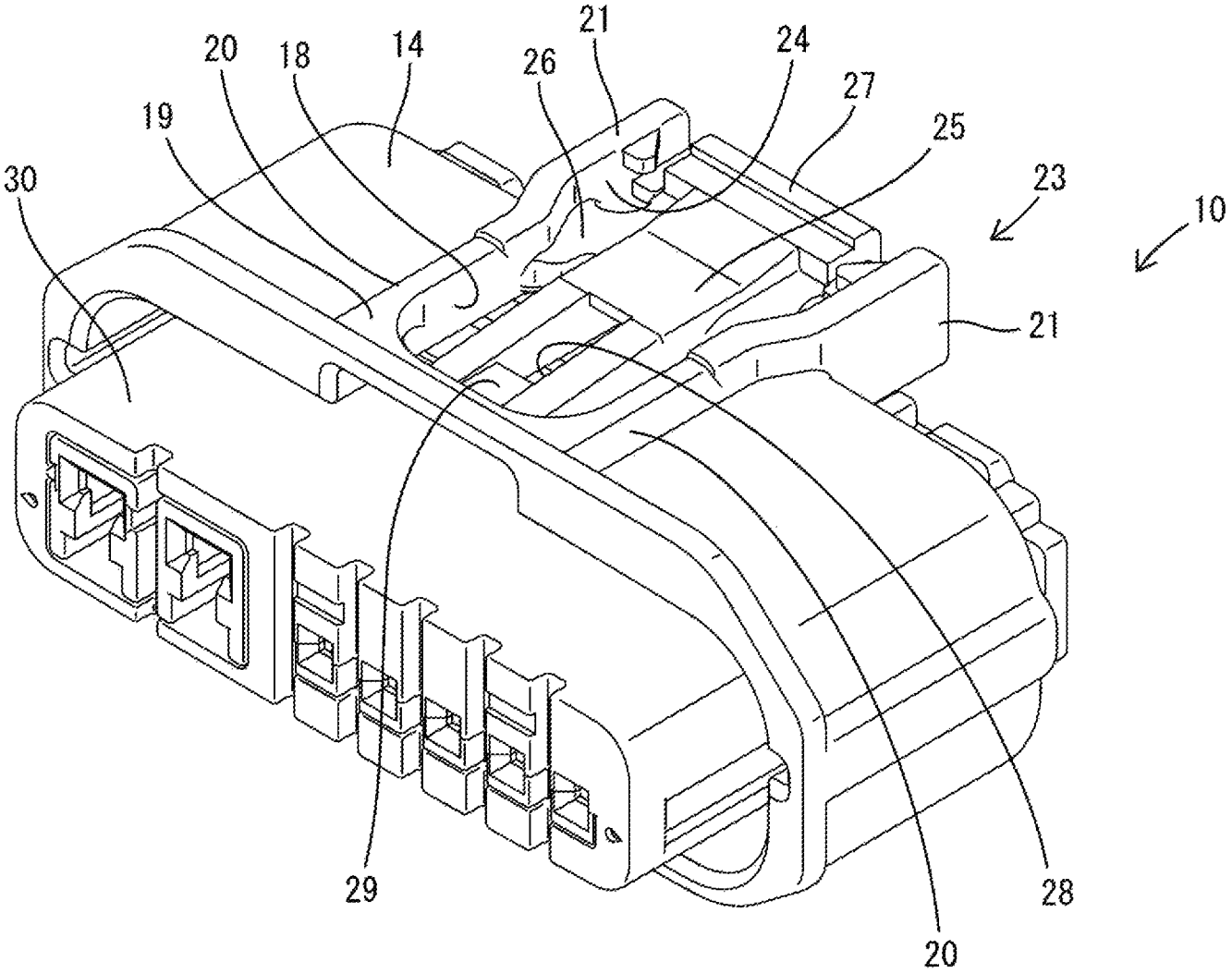
FIG. 5 is a perspective view of the first housing.
Figure 6:
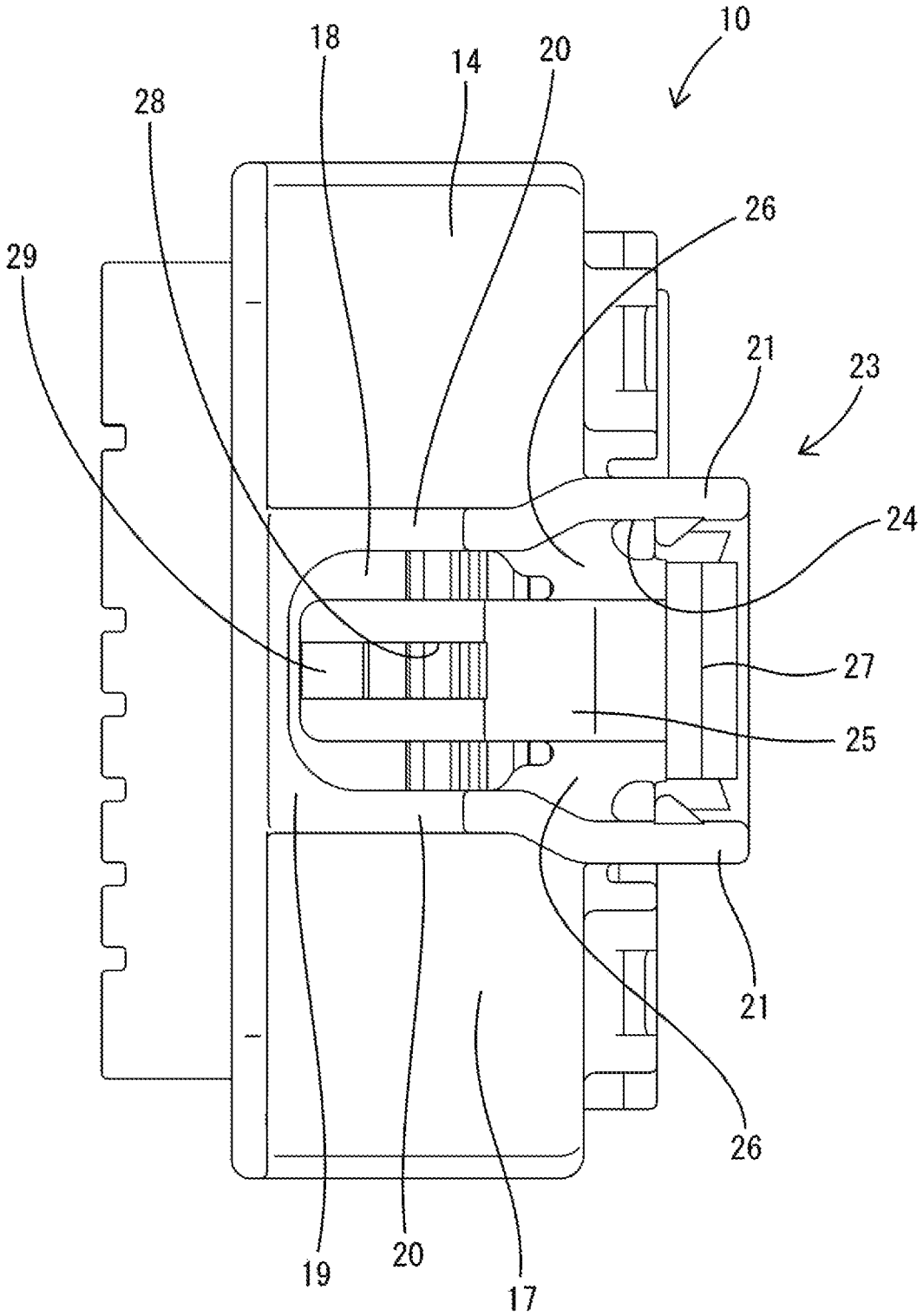
FIG. 6 is a plan view of the first housing.
Figure 7:
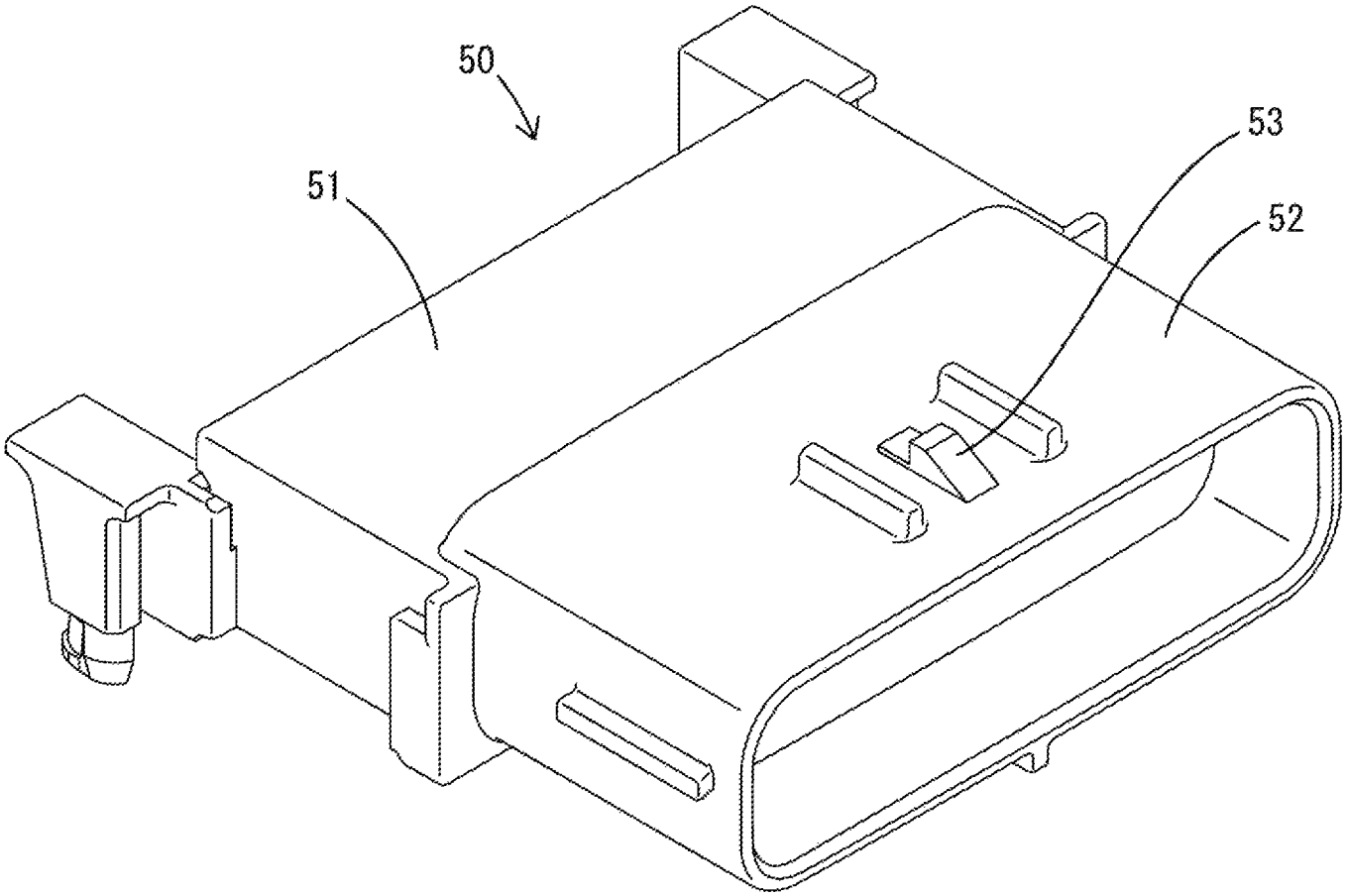
FIG. 7 is a perspective view of the second housing.

One specific embodiment of the present invention is described with reference to FIGS. 1 to 7. Note that, in the following description, a left side in FIGS. 1, 3, 4 and 6 is defined as a front concerning a front-rear direction. Upper and lower sides shown in FIGS. 1, 2, 4, 5 and 7 are defined as upper and lower sides concerning a vertical direction.

A connector of this embodiment includes a first housing 10 to be mounted on an end part of a wiring harness (not shown), a wire cover 33 attached to the first housing 10 and a second housing 50 to be placed and mounted on a circuit board (not shown).

The second housing 50 includes a terminal holding portion 51 in the form of a wide block and a receptacle 52 extending forward from the outer periphery of the front surface of the terminal holding portion 51. Male terminal fittings 54 formed by bending long and narrow metal wire materials are held in the terminal holding portion 51. A board connecting portion 55 on a base end of the male terminal fitting 54 is connected conductively to the circuit board. A tab 56 on a tip of the male terminal fitting 54 projects from the terminal holding portion 51 to be accommodated in the receptacle 52. A lock projection 53 is formed on the upper surface (outer surface) of an upper wall of the receptacle 52.

The first housing 10 includes a housing body 11 made of synthetic resin and a front retainer 30 made of synthetic resin. The housing body 11 is a single component including a terminal accommodating portion 12 in the form of a wide block and a tubular fitting 14 surrounding the terminal accommodating portion 12. Terminal accommodation chambers 13 are formed inside the terminal accommodating portion 12, and a female terminal fitting 31 of a known form is accommodated in each terminal accommodation chamber 13. The female terminal fittings 31 inserted into the terminal accommodation chambers 13 are retained and held by the front retainer 30 attached to the terminal accommodating portion 12. A wire 32 connected to a rear end part of each female terminal fitting 31 is drawn out rearward from the rear surface of the housing body 11.

The tubular fitting 14 includes a rear wall 15 connected to a rear end part of the outer periphery of the terminal accommodating portion 12 over the entire periphery and a peripheral wall 16 extending forward from the outer periphery of the rear wall 15 and surrounding the terminal accommodating portion 12. A cut 18 penetrates from the outer surface (upper surface) to the inner surface (lower surface) of an upper plate 17 in a laterally central part of the upper plate 17 of the peripheral wall 16. A formation area of the cut 18 in the front-rear direction is a range from a position slightly behind the front end of the tubular fitting 14 to the rear end of the upper plate 17. The rear end of the cut 18 is open on the rear end edge of the upper plate 17. The tubular fitting 14 is formed with an eave 19 horizontally protruding to a front part of the cut 18 from the inner surfaces of front end parts of ribs 20 to be described later.

The tubular fitting 14 includes two bilaterally symmetrical ribs 20, two bilaterally symmetrical side walls 21 and a lower wall 22. The ribs 20 rise up (toward the outer surface) from both left and right side edges of the cut 18. The side walls 21 are cantilevered forward from an opening end of the cut 18 out of a rear end part of the upper plate 17. The lower wall 22 couples the lower ends of the both left and right side walls 21, and the front end of the lower wall 22 is connected to the rear wall 15. The ribs 20, the side walls 21 and the lower wall 22 function as an arm holding portion 23 for holding a lock arm 25 to be described later. An internal space of the arm holding portion 23, i.e. a space defined by the ribs 20, the side walls 21 and the lower wall 22, serves as an accommodation space 24. The cut 18 constitutes part of the accommodation space 24.

The tubular fitting 14 is formed with the plate-like lock arm 25 having a rectangular shape long in the front-rear direction in a plan view. The lock arm 25 is accommodated in the accommodation space 24 of the arm holding portion 23, and is disposed between the ribs 20 and between the side walls 21. The lock arm 25 is connected to the inner surfaces of rear end parts of the ribs 20 via supports 26 projecting from both left and right side edges of the lock arm 25. An operating portion 27 is formed on a rear end part (area behind the supports 26) of the lock arm 25. The outer or upper surface of the operating portion 27 is pressed in an unlocking operation.

A lock hole 28 is formed in an area of the lock arm 25 in front of the supports 26 for allowing the upper and outer surfaces (outer and inner surfaces) of the lock arm 25 to communicate. The lock hole 28 has a substantially rectangular shape long in the front-rear direction in a plan view. A front opening edge of the lock hole 28 defines a lock 29 to be locked to the lock projection 53 of the second housing 50 with the housings 10, 50 connected.

The lock arm 25 normally is held in a locking posture but is resiliently displaced in a seesaw manner about the supports 26. When the lock arm 25 is displaced resiliently by pressing the operating portion 27, the lock 29 is displaced up away from the terminal accommodating portion 12 and the lock arm 25 is set in an unlocking posture.

The wire cover 33 is made of synthetic resin and is configured by uniting two vertically divided half bodies 34. The wire cover 33 is assembled with the first housing 10 to vertically sandwich the tubular fitting 14 by the half bodies 34. A front part of the wire cover 33 serves as a tubular attaching portion 35. A rear part of the wire cover 33 serves as a wire turning portion 36 having a wire draw-out opening 37 in a side surface.

With the wire cover 33 attached to the first housing 10, an area of the outer peripheral surface of the tubular fitting 14, excluding the arm holding portion 23 and the lock arm 25, is covered by the attaching portion 35, and the wire turning portion 36 is disposed behind the first housing 10. Wires 32 drawn out rearward from the first housing 10 are bent laterally in the wire turning portion 36, and pulled out to the outside of the wire cover 33 through the wire draw-out opening 37.

The upper half body 34 of the wire cover 33 is formed with an opening 38, a covering portion 39 and an intrusion restricting portion 40. The opening 38 is cut to allow the outer and inner surfaces (upper and lower surfaces) of the wire cover 33 to communicate. The front end of the opening 38 is open to an outer front side of the wire cover 33 on a front edge (outer edge) of the half body 34 (wire cover 33). With the wire cover 33 attached to the first housing 10, the ribs 20 and the side walls 21 are fit to the opening edge of the opening 38, and the arm holding portion 23 and the lock arm 25 are disposed in the opening 38. Thus, in the opening 38, an area of the lock arm 25 at least including the operating portion 27 and the supporting portions 26 is exposed.

The covering portion 39 couples two left and right areas adjacent to the open front end of the opening 38 in a bridged manner. Thus, the covering portion 39 covers a substantially entire area of the lock hole 28 (excluding a rear end part) and the lock portion 29 of the lock arm 25 from an outer surface side (from above). The covering portion 39 covers only a front area of the lock arm 25, and the operating portion 27 remains exposed.

The intrusion restricting portion 40 is cantilevered down toward the lock arm 25 from the rear end of the covering portion 39. A lower end part of the intrusion restricting portion 40 is accommodated in a rear end area of the lock hole 28. A position where this intrusion restricting portion 40 is accommodated is an area behind an area where the lock projection 53 is accommodated when the housings 10, 50 are connected.

The housings 10, 50 are connected by fitting the receptacle 52 of the second housing 50 is fit into a space between the terminal accommodating portion 12 and the tubular fitting portion 14. In the process of connecting the housings 10, 50, the front end part (lock portion 29) of the lock arm 25 interferes with the lock projection 53, and the lock arm 25 is displaced resiliently to the unlocking posture. When the housings 10, 50 are connected properly, the lock 29 passes over the lock projection 53, and the lock arm 25 resiliently returns so that the lock projection 53 is accommodated in a front end area of the lock hole 28.

With the housings 10, 50 connected, the lock projection 53 approaches from behind to face and be lockable to the lock portion 29. Thus, even if an attempt is made to separate the second housing 50 forward from the first housing 10, the lock projection 53 is locked to the lock portion 29, thereby restricting the separation of the housings 10 50. In this way, the housings 10, 50 are locked in the connected state. To separate the connected housings 10, 50, the operating portion 27 is pressed to resiliently displace the lock arm 25 to the unlocking posture. Since the lock 29 is disengaged from the lock projection 53 in this way, the housings 10, 50 may be pulled apart with the operating portion 27 kept pressed.

The lock arm 25 is exposed partially to outside without being covered by the wire cover 33 in the connector of this embodiment. Thus, mud spattered up from a road surface during travel may adhere to a locking part of the lock 29 and the lock projection 53. If this adhering mud is dried and hardened, it may become impossible to unlock the lock arm 25.

As a countermeasure against this, the lock 29 and the lock projection 53 are covered from the outer surface by the covering portion 39 with the housings 10, 50 connected. This makes it difficult for external matter to intrude to the locking part of the lock 29 and the lock projection 53 from above. Further, the front end part of the covering portion 39 is in contact with or proximately faces the upper surface of the eave 19. Thus, there is almost no clearance between the covering portion 39 and the tubular fitting 14, and there is no possibility that an external matter intrudes into the accommodation space 24 from the front of the tubular fitting portion 14 and the covering portion 39.

The intrusion restricting portion 40 is close a clearance between the covering portion 39 and the upper or outer surface of the lock arm 25 behind the covering portion 39. Thus, external matter cannot intrude to parts of the lock hole 28 and the lock projection 53 from behind the covering portion 39. Furthermore, an extending lower end part of the intrusion restricting portion 40 is accommodated in the opening area of the lock hole 28 behind the lock projection 53. This makes it difficult for external matter to intrude into a clearance between the rear end of the lock hole 28 and the lock projection 53. As described above, mud is not likely to adhere to the locking part of the lock portion 29 of the lock hole 28 and the lock projection 53.

The connector includes the first housing 10 having the resiliently deformable lock arm 25. The lock hole 28 is formed in the lock arm 25. The second housing 50 is connectable to and separable from the first housing 10, and the lock projection 53 formed on the second housing 50 is configured to lock the housings 10, 50 in the connected state by being locked to the lock portion 29 of the lock hole 28. The wire cover 33 is attached to the first housing 10 and is configured to turn the wires 32 drawn out from the first housing 10. The wire cover 33 is formed with the covering portion 39 that covers the lock portion 29 of the lock hole 28 and the lock hole 53 from the outer side. Since by the covering portion 39 covers the locking part of the lock hole 28 and the lock projection 53, external matter will not hinder the unlocking operation of the lock arm 25 due to the adhesion of external matter (mud) to the locking part of the lock hole 28 and the lock projection 53.

The lock arm 25 has the operating portion 27 for the unlocking operation capable of disengaging the lock hole 28 from the lock projection 53 by being pressed, and the wire cover 33 is formed with the opening 38 to expose the operating portion 27. Thus, the lock arm 25 can be unlocked even without detaching the wire cover 33 from the first housing 10.

The opening 38 is open to the outside of the wire cover 33 on the front part of the wire cover 33. Thus, the strength of the front part of the wire cover 33 may be reduced. However, the covering portion 39 couples areas adjacent the front end of the opening 38 to ensure sufficient strength on the front edge part of the wire cover 33.

If an opening area of the lock hole 28 is increased, the formation of sinks of the lock arm 25 can be suppressed in a molding step but, on the other hand, the intrusion of an external matter into the lock hole 28 becomes easier. Accordingly, the wire cover 33 is formed with the intrusion restricting portion 40 to be accommodated into the area not interfering with the lock projection 53. In this way, even if the opening area of the lock hole 28 is increased, the intrusion of an external matter into the lock hole 28 can be restricted.

The intrusion restricting portion 40 extends from the covering portion 39. Thus, no clearance exists between the covering portion 39 and the intrusion restricting portion 40, and a function of restricting the intrusion of an external matter into the lock hole 28 is excellent.

The invention is not limited to the above described and illustrated embodiment. For example, the following embodiments also are included in the scope of the invention.

Although the wire cover is formed with the opening for exposing the operating portion to outside in the above embodiment, the wire cover may not include such an opening.

Although the covering portion couples the areas adjacent to the opening end of the opening out of the outer edge part of the wire cover in the above embodiment, the covering portion may be cantilevered from an area adjacent to the opening end of the opening.

Although the intrusion restricting portion on the wire cover is accommodated in the lock hole in the above embodiment, the wire cover may have no intrusion restricting portion.

Although the intrusion restricting portion extends from the covering portion in the above embodiment, the intrusion restricting portion may extend from a position of the wire cover different from the covering portion.

Although the second housing is mounted on the circuit board in the above embodiment, the invention can be applied when the second housing is mounted on an end part of a wiring harness.

LIST OF REFERENCE SIGNS

10 . . . first housing
25 . . . lock arm
27 . . . operating portion
28 . . . lock hole
32 . . . wire
33 . . . wire cover
38 . . . opening
39 . . . covering portion
40 . . . intrusion restricting portion
50 . . . second housing
53 . . . lock projection

What is claimed is:

1. A connector, comprising:

a first housing including a resiliently deformable lock arm;

a lock hole formed in the lock arm;

a second housing connectable to and separable from the first housing;

a lock projection formed on the second housing and configured to lock the first housing and the second housing in a connected state by being locked to the lock hole;

an operating portion formed on the lock arm and capable of being pressed for disengaging the lock hole from the lock projection and thereby performing an unlocking operation;

a wire cover to be attached to the first housing and configured to turn a wire drawn out from the first housing;

an opening formed in the wire cover and configured to expose the operating portion; and a covering portion formed on the wire cover and configured to cover a locking part of the lock hole and the lock projection from an outer surface side.

2. The connector of claim 1, wherein the opening is open to outside of the wire cover on an outer edge part of the wire cover, and the covering portion couples two areas adjacent to an opening end of the opening.

3. The connector of claim 1, comprising an intrusion restricting portion formed on the wire cover and accommodated in an area not interfering with the lock projection.

4. The connector of claim 3, wherein the intrusion restricting portion extends from the covering portion.

* * * * *